US006050039A

United States Patent [19]

O'Hagin

[11] Patent Number: 6,050,039

[45] Date of Patent: Apr. 18, 2000

[54] ATTIC VENT WITH A ONE-PIECE, FITTED SKELETON

[76] Inventor: Harry O'Hagin, 1036 Ragal, Sebastopol, Calif. 95472

[21] Appl. No.: 09/034,736

[22] Filed: Mar. 3, 1998

[51] Int. Cl.[7] ..... F24F 7/02

[52] U.S. Cl. ..... 52/302.1; 52/198; 52/199; 52/302.3; 454/250; 454/242

[58] Field of Search ..... 52/198, 199, 302.1, 52/302.3; 454/250, 252, 242

[56] References Cited

U.S. PATENT DOCUMENTS

| | | | |
|---|---|---|---|
| 938,930 | 11/1909 | Wiest . | |
| 1,381,630 | 6/1921 | Goodrich . | |
| 1,496,670 | 6/1924 | Floyd . | |
| 2,692,548 | 10/1954 | Knorr . | |
| 2,905,072 | 9/1959 | Oswald . | |
| 3,093,059 | 6/1963 | Metz . | |
| 4,090,435 | 5/1978 | Vallee . | |
| 4,297,818 | 11/1981 | Anderson . | |
| 4,498,267 | 2/1985 | Beck . | |
| 4,803,816 | 2/1989 | Klöber . | |
| 4,899,505 | 2/1990 | Williamson et al. . | |
| 5,054,254 | 10/1991 | Sells | 52/199 |
| 5,326,318 | 7/1994 | Rotter | 52/199 X |
| 5,593,348 | 1/1997 | Rickert | 52/199 X |
| 5,697,842 | 12/1997 | Donnely | 52/199 X |
| 5,738,581 | 4/1998 | Rickert et al. | 52/199 X |
| 5,766,071 | 7/1998 | Kirckwood | 52/198 X |

FOREIGN PATENT DOCUMENTS

| | | |
|---|---|---|
| 0 695 839 | 2/1995 | European Pat. Off. . |
| 911724 | 7/1946 | France . |
| 2 476 722 | 8/1981 | France . |
| 2683570 | 5/1993 | France . |
| 2683571 | 5/1993 | France . |
| 2 687 181 | 8/1993 | France . |
| 3698902 | 6/1994 | France . |
| 2128035 | 12/1972 | Germany . |
| 9000176 | 8/1991 | Netherlands . |
| 593645 | 10/1947 | United Kingdom . |
| 1 366 505 | 11/1973 | United Kingdom . |
| 1 393 977 | 5/1975 | United Kingdom . |
| 1 591 627 | 6/1981 | United Kingdom . |
| 2 145 131A | 3/1985 | United Kingdom . |
| 2 199 860A | 7/1988 | United Kingdom . |
| 2 236 775A | 4/1991 | United Kingdom . |
| 2 262 295A | 6/1993 | United Kingdom . |
| 2 262 949A | 7/1993 | United Kingdom . |
| 2 271 585A | 4/1994 | United Kingdom . |
| 2288227 | 10/1995 | United Kingdom . |
| WO 98/15701 | 4/1998 | WIPO . |

*Primary Examiner*—Beth Aubrey
*Assistant Examiner*—Brian E. Glessner
*Attorney, Agent, or Firm*—Irell & Manella LLP

[57] ABSTRACT

The present invention provides a ventilation system for an attic or rafter space that mimics the appearance of the roofing material and thus has little effect on the appearance of the building. The vent has two pieces, a primary vent and a secondary vent and they may be made of aluminum, galvanized steel or copper. The primary vent is installed on a roof deck over a ventilation opening cut through the deck. The secondary vent is constructed to look like the surrounding field tiles and is installed over the primary vent. One or more vent openings in the secondary vent and an opening in the primary vent conduct air between the attic or rafter space and the outside. The secondary vent has a skeleton with one or more vent openings and a cap covering each opening shielding the ventilating space. Skeletons are formed in one piece and are made to fit each different size and type of roofing tile. The caps and the skeleton are ribbed for rigidity. The caps are made in one size only to minimize manufacturing and inventory complexity, thus any cap may be fitted on any skeleton.

26 Claims, 7 Drawing Sheets

FIG. 8
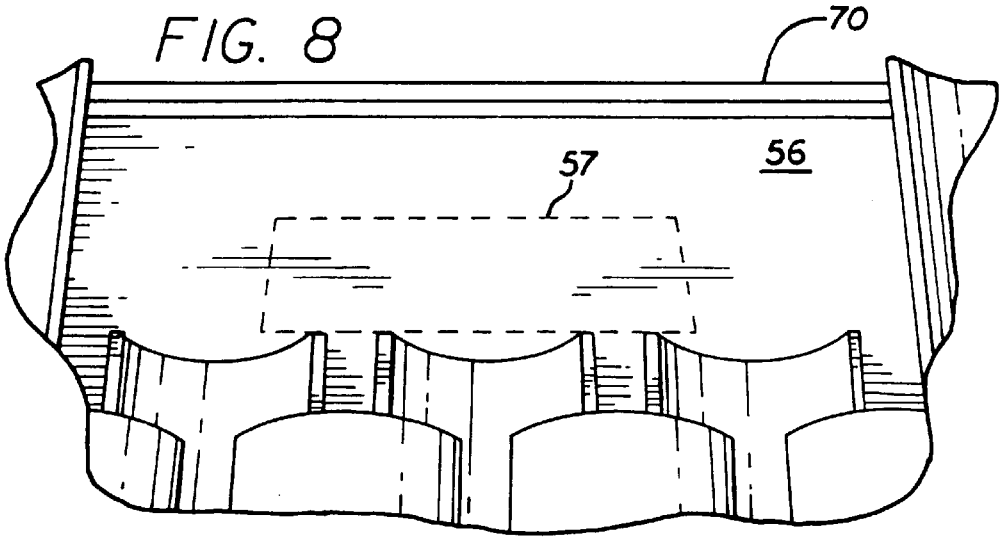
FIG. 9
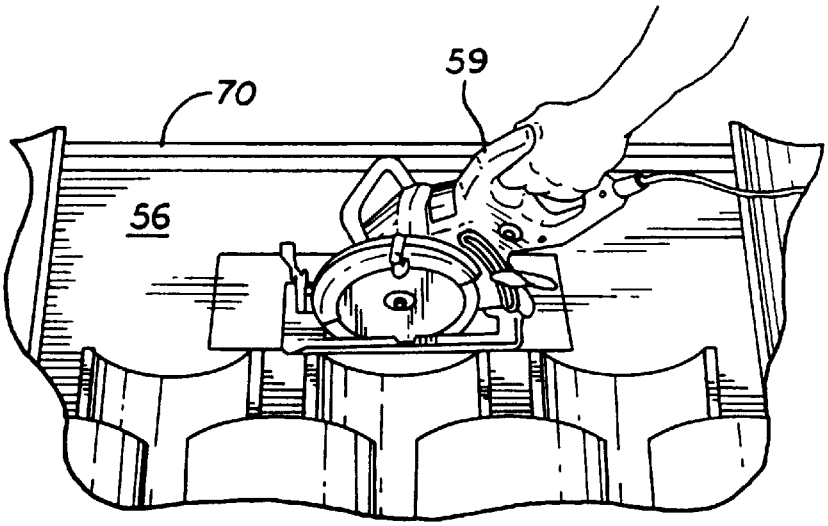
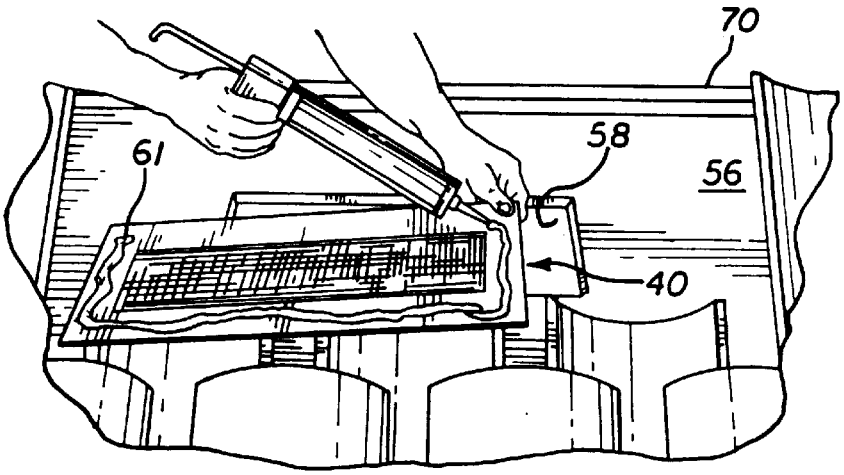
FIG. 10

20
20
18
18
34
34
50
50
12
70
40
46
45
45

ATTIC VENT WITH A ONE-PIECE, FITTED SKELETON

BACKGROUND OF THE INVENTION

1. Field of the Invention

This invention relates to roof vents, and more specifically to passive attic vents for use on tile roofs.

2. Description of the Prior Art

Energy efficiency is a serious consideration in new home design. New homes require ways to minimize energy requirements to maintain comfortable living spaces. One of the most common energy losses in a home is due to heat transfer through the attic. In warm climates, heat builds up in the attic from solar energy incident on the roof. In colder climates, moisture builds up in the attic, robbing the insulation of much of it's R value. Early efforts at minimizing the effects of the heat and/or moisture build-up focused on the insulation between the living space and the attic. Gable vents and dormer type passive ventilation systems have been incorporated to ventilate the attic. In the southwest, many homes have low pitch, hip roofs which have no gables, and dormers may destroy the aesthetics of a design if improperly located or too numerous. Therefore, these systems have proven to be inadequate.

A passive attic vent with a camouflaged appearance has been marketed in recent years. This camouflaged vent has been difficult to manufacture and install.

What is needed is an improved passive ventilation system that will not effect the appearance of a building design if used in adequate numbers to properly ventilate the attic, and is useable on many roof configurations and with many types of roofing material.

SUMMARY OF THE INVENTION

The present invention provides a ventilation system for an attic or rafter space that mimics the appearance of roofing tiles and thus has a minimal negative effect on the appearance of the building. The vent has two pieces, a primary vent, and a secondary vent and they may be made of aluminum, steel or copper. The primary vent is installed on a roof deck with a primary vent opening over a ventilation opening cut through the deck. The secondary vent is constructed to look like the surrounding field tiles and is installed over the primary vent. The secondary vent has a skeleton with one or more vent openings and a cap covering each opening creating a ventilating access. The one or more vent openings in the secondary vent and the opening in the primary vent conduct air between the attic or rafter space and the outside.

In a first aspect, the present invention provides a roof vent for mounting between field tiles on a pitched, tile roof, the roof vent includes a primary vent for mounting on the roof in ventilating communication with an opening there through, a roof tile-shaped vent skeleton having an upslope edge and a parallel downslope edge and a pitch axis perpendicular to the upslope and the downslope edges, the vent skeleton is formed of a single continuous piece of material and includes one or more vent openings, the vent skeleton is mounted on the roof above the primary vent with the pitch axis of the vent skeleton parallel to the roof pitch with the vent openings in ventilating communication with the roof opening, and a vent cap attached to the vent skeleton adjacent each of the one or more vent openings creating a ventilating access between the vent cap and the skeleton.

In another aspect, the present invention provides a roof vent wherein the upslope and downslope edges precisely fit against adjacent upslope and downslope field tiles respectively, and the vent skeleton has a cap flange to precisely fit under and against the cap of an adjacent field tile, and the vent skeleton also has a pan flange to precisely fit against a pan of an adjacent field tile.

In a still further aspect, the present invention provides a vent skeleton having a plurality of ribs perpendicular to the pitch axis.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 8 is a perspective view of a mounting location for a primary vent showing the hole marked on the roof.

FIG. 9 is a perspective view of a mounting location for a primary vent showing the hole being cut in the roof.

FIG. 10 is a perspective view of a mounting location for a primary vent showing the primary vent being prepared for installation.

DETAILED DESCRIPTION OF THE PREFERRED EMBODIMENT(S)

Figure 1:
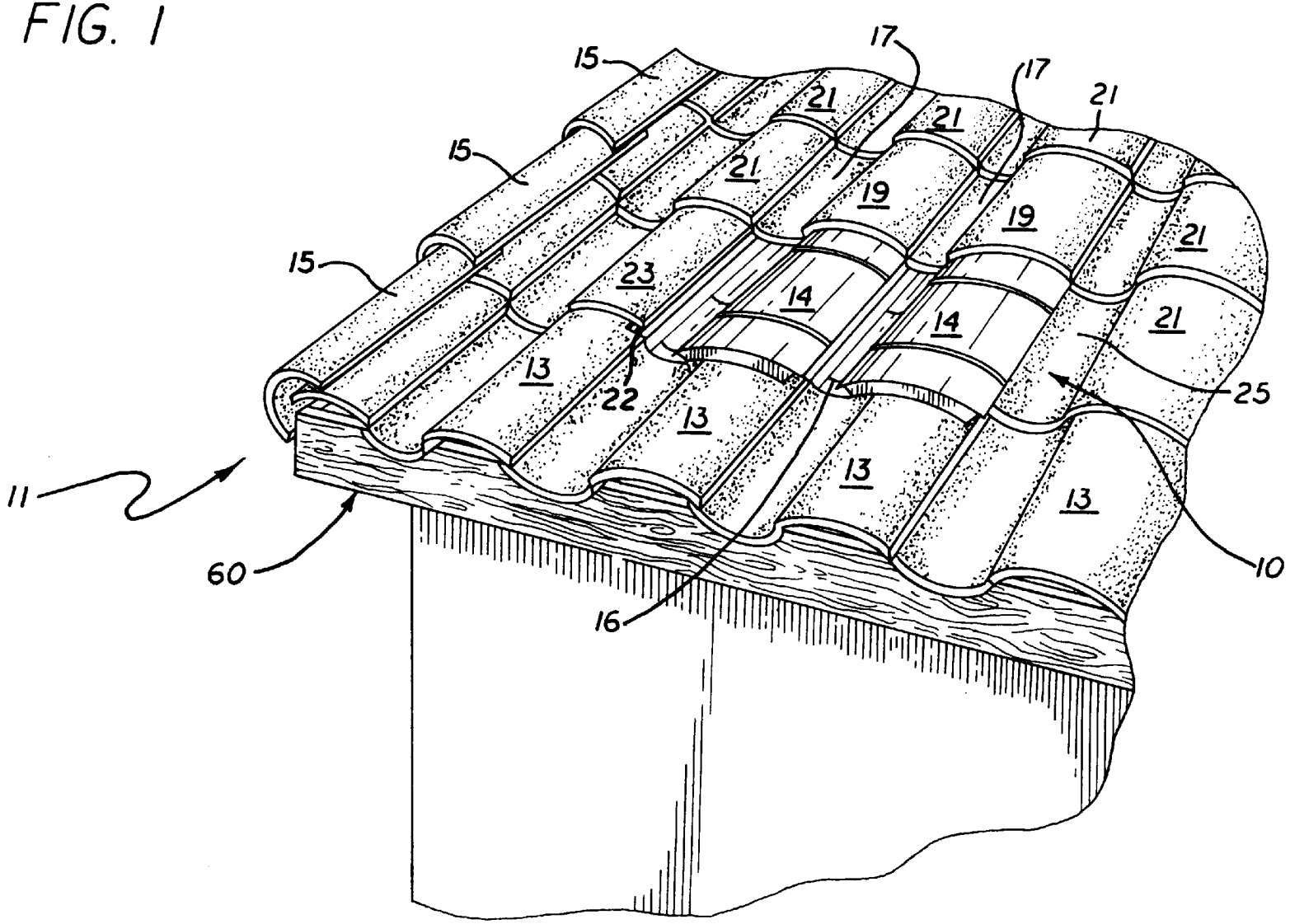
FIG. 1 is a perspective view of a secondary vent skeleton and caps, according to the present invention, installed on a portion of a roof.

Referring to FIG. 1, a section of pitched roof 11 near eave 60 is shown including a roof vent 10 according to a preferred embodiment of the present invention. Pitched roof 11 is generally composed of a plurality of field tiles 21, surrounded by edge tiles 13, edge caps 15 and ridge caps (not shown). Roof vent 10 is in two parts, primary vent 40 (shown in FIG. 11) and secondary vent 12. Roof vent 10 may be formed from any suitable metal such as aluminum, steel, or copper. In a currently preferred embodiment of the present invention roof vent 10 is formed of 26 gauge galvanized steel.

Figure 2:
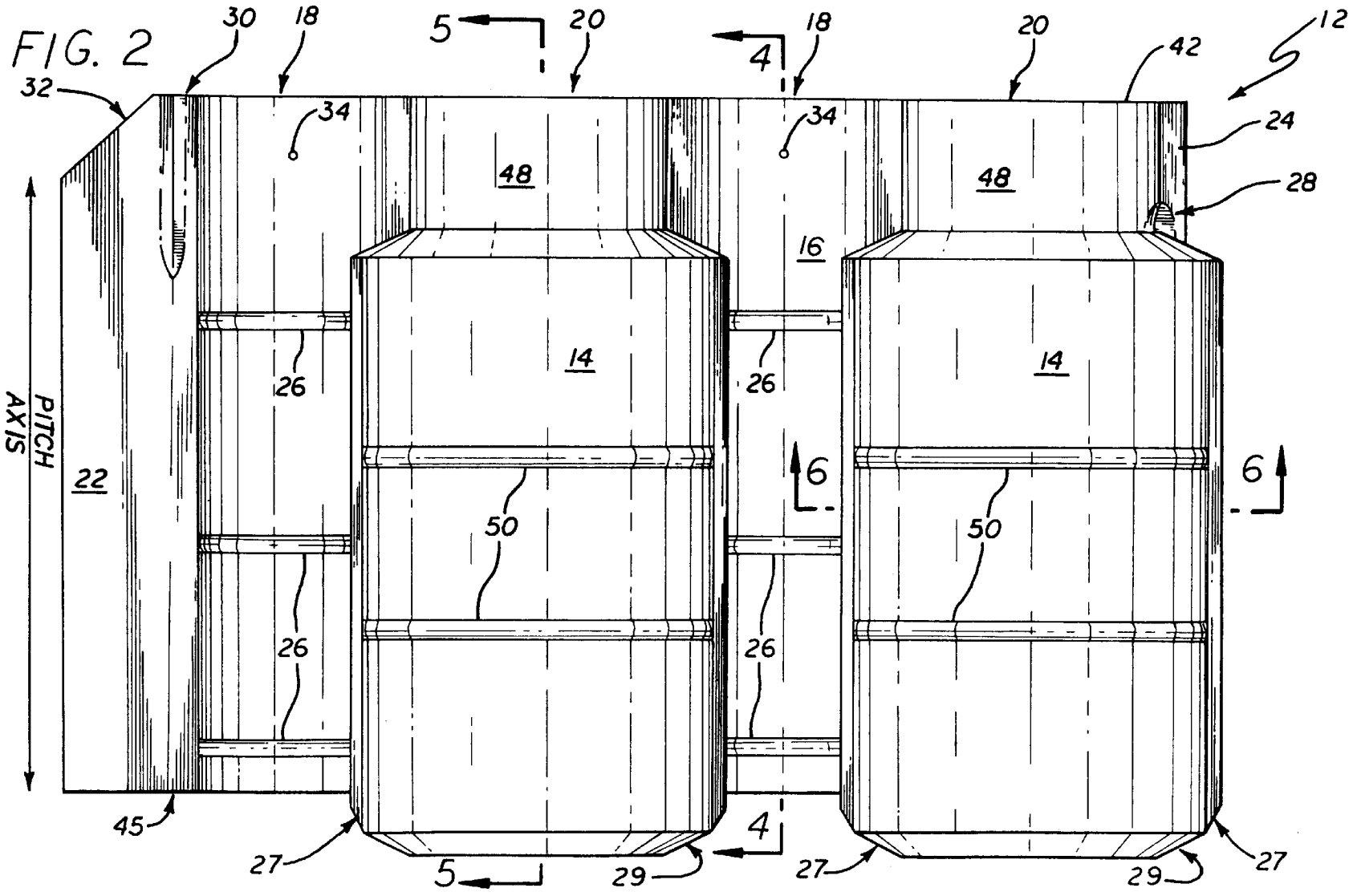
FIG. 2 is a top view of a secondary vent skeleton and caps according to the present invention.

Referring now to FIG. 2, secondary vent 12 includes one or more caps 14 attached to skeleton 16. Secondary vent 12 serves as a replacement for one or more field tiles 21 on pitched roof 11. Different tile types and similar looking tiles from different manufacturers have different physical dimensions and may require a unique skeleton configuration for a precise fit between the tiles and skeleton 16. Skeleton 16 may be made to fit the contours and edge configuration of the field tiles 21 used. Skeleton 16 may be formed in any conventional manner. In a currently preferred embodiment of the present invention, skeleton 16 is stamped from a single piece of material to fit precisely the field tiles 21 for which it is intended to be used. Skeleton 16 includes one or more pan areas 18 and a cap area 20 adjacent each pan area 18. Viewed from above, pan areas 18 are concave and cap areas 20 are convex. Pan areas 18 align with individual pan tiles or with corresponding pan areas of field tiles such as pan areas 17 of FIG. 1. Cap areas 20 align with individual cap tiles or with corresponding cap areas of field tiles 21 such as cap areas 19 of FIG. 1. Secondary vent 12 is mounted with the pitch axis parallel to the pitch of pitched roof 11.

Cap flange 22 is configured to fit underneath the cap of an adjacent field tile such as cap 23 as shown in FIG. 1. Cap flange 22 may include one or more creases such as crease 30 to obtain a precise fit to an adjacent field tile. Cap flange 22 may also have one or more bevels such as bevel 32 to minimize interference with an adjacent field tile. Pan flange 24 is configured to mate with the pan of an adjacent field tile such as pan 25 as shown in FIG. 1. Pan flange 24 may include one or more creases such as crease 28 to obtain a precise fit to an adjacent field tile. A plurality of ribs 26, 26A and 26B are stamped into skeleton 16 for increased rigidity. In a currently preferred embodiment of the present invention ribs 26, 26A and 26B are parallel to upslope edge 42. A hole 34 is included in each pan area 18 to accept a conventional fastener, such as a nail or a screw, to secure secondary vent 12 to a roof such as pitched roof 11.

Figure 3:
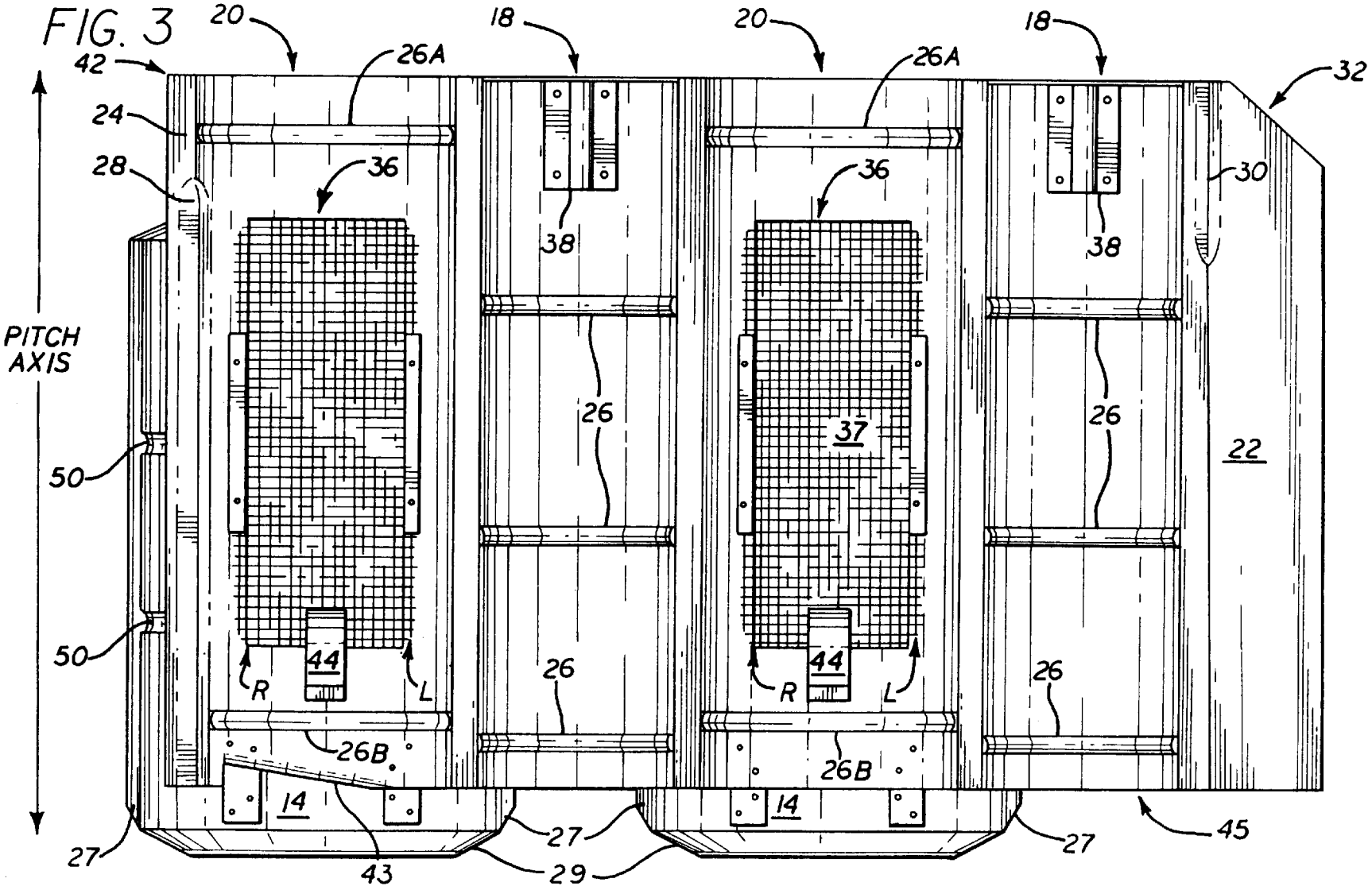
FIG. 3 is a bottom view of the secondary vent skeleton and caps of FIG. 2.
Figure 11:
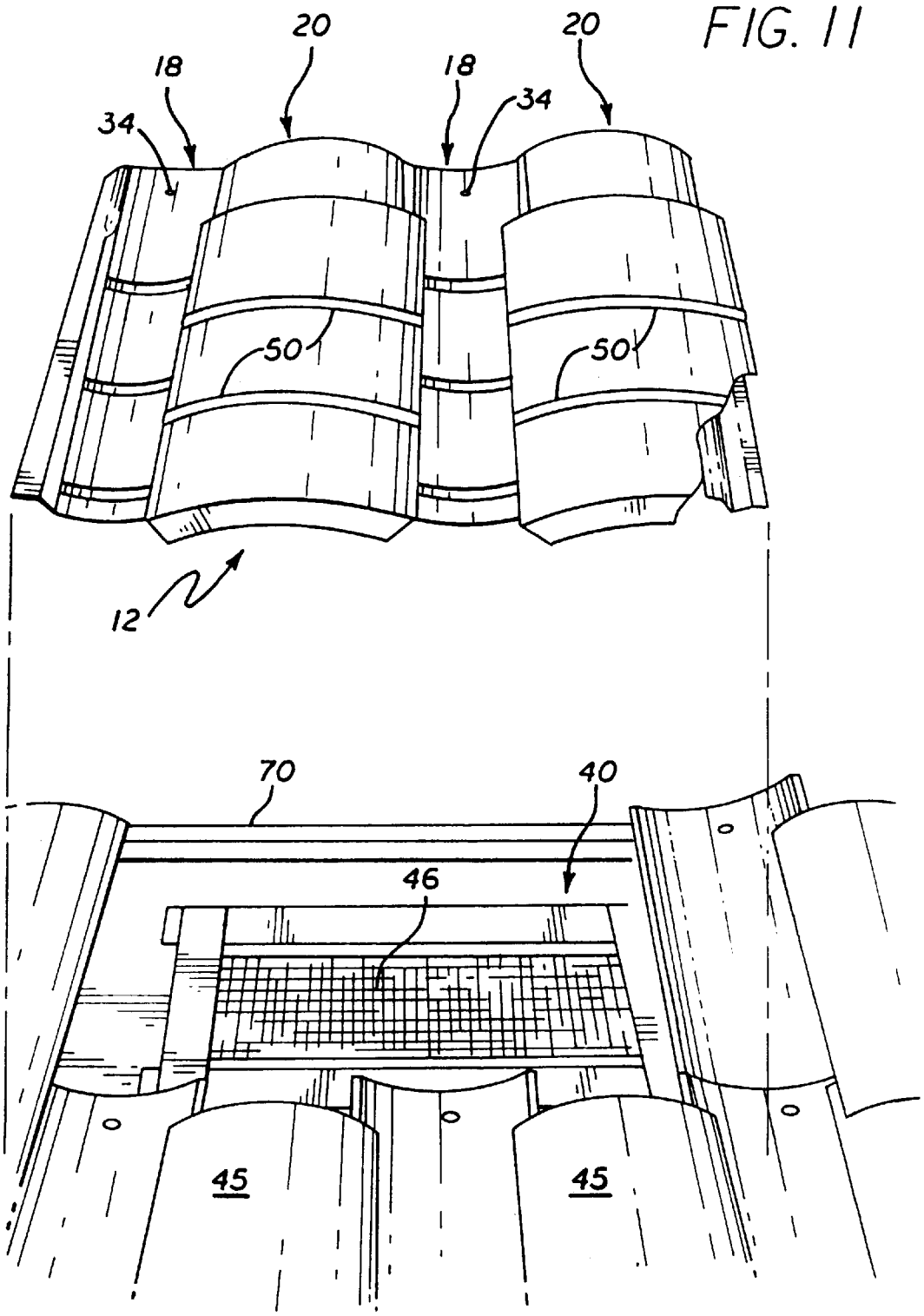
FIG. 11 is a perspective view of an installed primary vent showing the relationship to a secondary vent according to the present invention.

Referring now to FIG. 3, the underside of skeleton 16 is shown in more detail. Skeleton 16 includes a vent opening 36 in each cap area 20. When installed above primary vent 40 as shown in FIG. 11, vent openings 36 are in ventilating communication with vent opening 46. Each vent opening 36 is located between ribs 26A and 26B. A turtle 38 is attached to each pan area 18 adjacent edge 40. Turtle 38 is a spacer that compensates for the difference in thickness between field tiles 21 and skeleton 16. Turtle 38 may be formed and attached in any conventional manner to raise skeleton 16 above the roof battens such as batten 70 (in FIG. 11). Thickness compensating fingers 43 are formed along the downslope edge 45 of cap area 20. Thickness compensating fingers 43 compensate for the difference in thickness between field tiles 21 and skeleton 16 to provide a seal against the top a downslope field tile. Wind clips 44 are attached to skeleton 16 to secure secondary vent 12 to lower course tiles 45 shown in FIG. 11.

Figure 4:
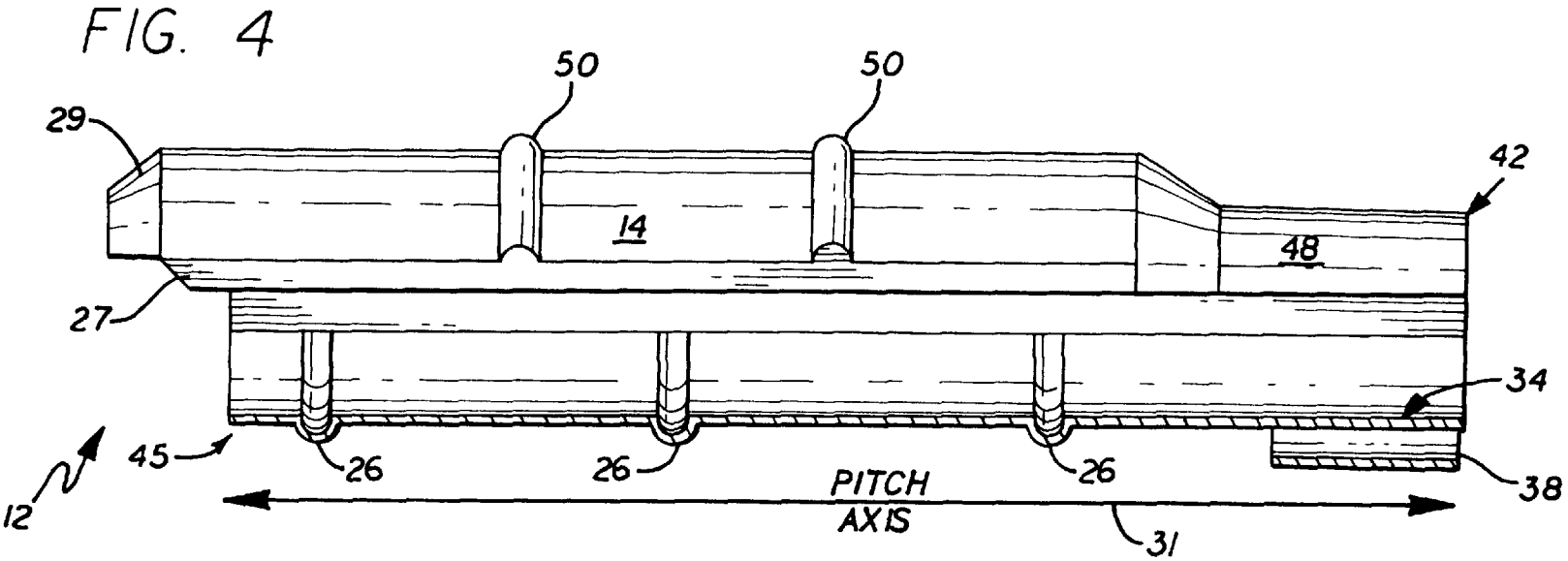
FIG. 4 is a cross-section view of the secondary vent skeleton and caps of FIG. 2 taken along 4—4.
Figure 5:
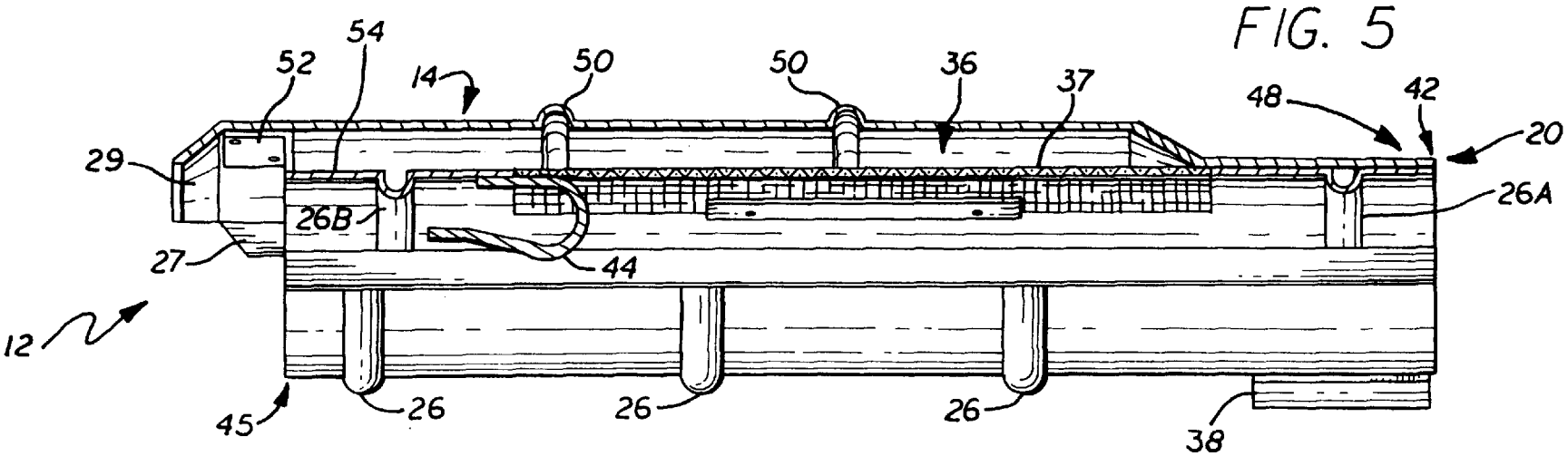
FIG. 5 is a cross-section view of the secondary vent skeleton and caps of FIG. 2 taken along 5—5.

Referring now to FIGS. 4 and 5, ribs 26, 26A, 26B, 50 and turtle 38 are seen in profile. Ribs 26 are shown concave up however other configurations may be suitable. Rib 26B is shown convex up however other configurations may be suitable. Rib 26A must be oriented concave up to minimize interference with caps 14 at shoulder 48. Ribs 50 are shown concave down however other configurations may be suitable. Legs 52 are attached to skeleton 16 and to caps 14 to support caps 14 and maintain ventilating access 54 between skeleton 16 and caps 14. Legs 52 may be attached in any conventional manner.

Caps 14 shield vent openings 36 from the weather and are attached to cap area 20 by any conventional means. In a currently preferred embodiment of the present invention a cap 14 is spot welded at shoulder 48 and legs 52. Caps 14 include side hems 27, a front hem 29, and ribs 50. In a currently preferred embodiment of the present invention, ribs 50 extend from one side hem 27 to the other parallel to front hem 29. Side hems 27 and front hem 29 are included to improve the weather shielding efficiency of cap 14 without sacrificing ventilating efficiency. Ribs 50 are stamped into caps 14 for rigidity. Front and side hems 29 and 27 may be made in any conventional manner such as cutting and bending. In a currently preferred embodiment of the present invention, front and side hems 29 and 27 are formed by stamping to increase the rigidity of caps 14, and caps 14 are made in one standard size. A standard size cap 14 may be fitted to many different skeletons thus minimizing manufacturing and inventory complexity.

Figure 6:
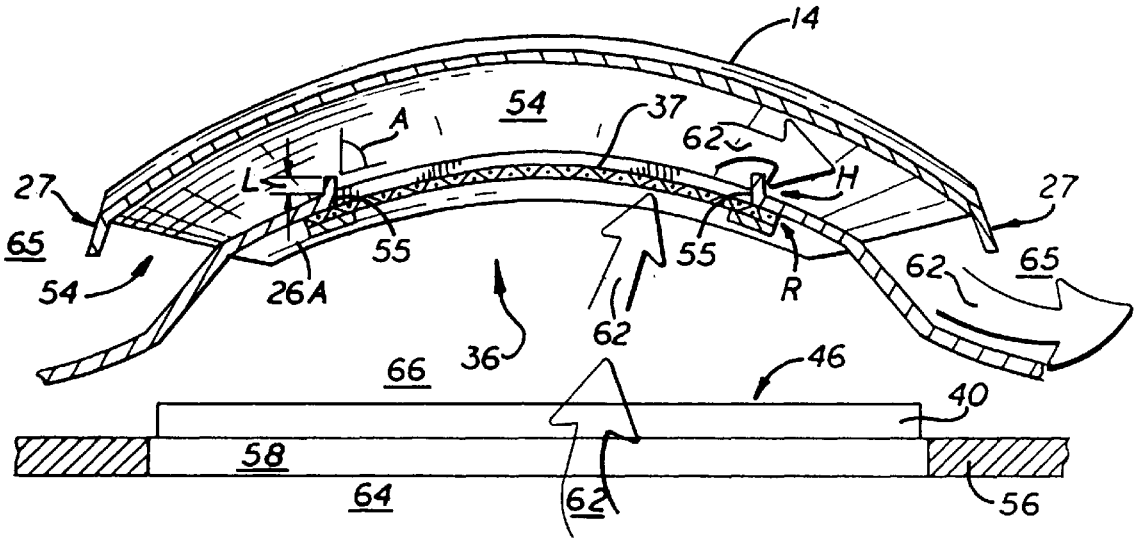
FIG. 6 is a cross-section view of the secondary vent skeleton and caps of FIG. 2 taken along 6—6.

Referring now to FIG. 6, the uniform relationship between skeleton 16 and caps 14 is shown. Vent 10 serves dual purposes, ventilating attic 64 and protecting attic 64 from weather and pests. Vent opening 36, vent opening 46 and attic opening 58 cooperate to conduct attic air 62 from attic 64. Caps 14 are attached to skeleton 16 as shields over vent opening 36 to prevent weather and pests from falling directly into attic 64. Caps 14 also prevent direct solar irradiation of attic 64. Vent openings 36 are covered by screen 37 to prevent entry into space 66 by pests larger than the screen openings. Baffles 55 shield vent openings 36 from wind driven moisture and particles, and extend along edges R and L. Baffles 55 are H high and they are folded up along angle A between 0° and 90° from vent opening 36. In a currently preferred embodiment of the present invention, H is 0.25" and angle A is 50°. Cap 14 includes side hems 27, and a front hem 29 (shown in FIG. 7) to further shield vent opening 36 from entry of foreign matter. Side hems 27, and front hem 29 extend from cap 14 to below vent opening 36.

Attic air 62 flowing through a passive vent such as vent 10 follows the same path whether from outside 65 into attic 64, or from within the attic 64 to outside 65, only the direction of flow changes. For the sake of simplicity, attic air 62 flow from attic 64 to outside 65 will now be described with the understanding that the present invention functions equally well conducting air in both directions. Air travelling through vent 10 must undergo a change of direction that helps to prevent foreign matter from entering attic 64. As installed, vent opening 46 of primary vent 40 provides a convection driven ventilating channel through roof deck 56. Primary vent 40 conducts air up from within attic 64 through attic opening 58 and vent opening 46 to space 66. Convection continues to drive attic air 62 up through vent opening 36 into ventilating access 54. Attic air 62 in ventilating access 54 is then conducted up over baffles 55. Once above baffles 55 the shape of vent cap 14 and hems 27 and 29 cause attic air 62 to change direction and travel down beyond side hems 27 or front hem 29 to outside 65.

Figure 7:
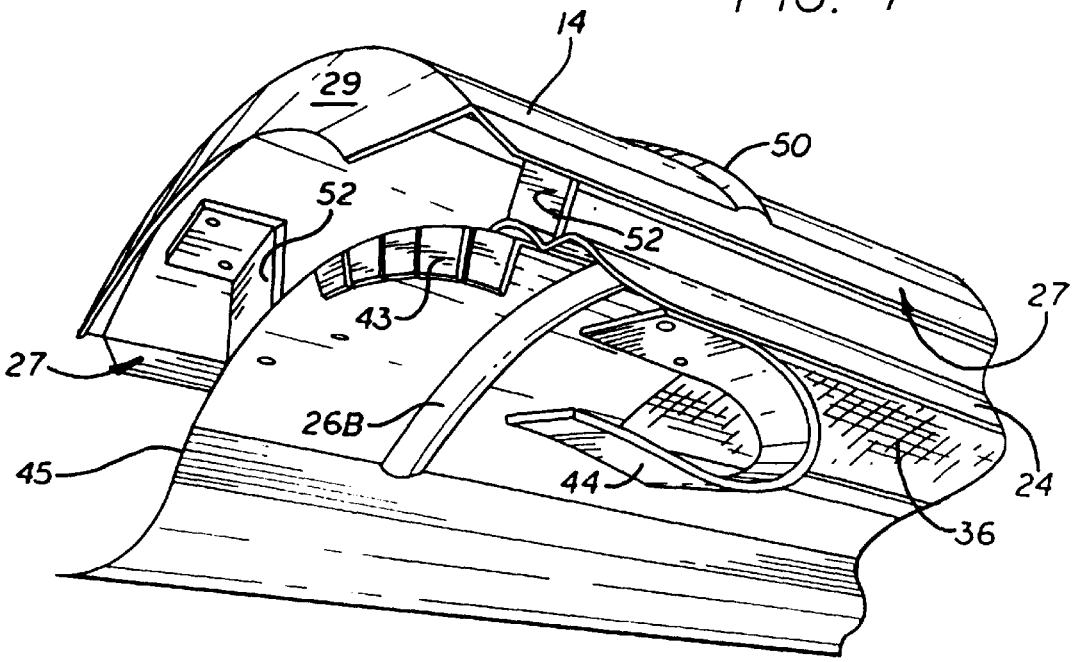
FIG. 7 is a perspective view from below of the front cap corner of a secondary vent skeleton and cap according to the present invention.

Referring now to FIG. 7, thickness compensating fingers 43 and a wind clip 44 are shown in more detail. Thickness compensating fingers 43 may be formed by any conventional means, in a currently preferred embodiment of the present invention, thickness compensating fingers 43 are cut into downslope edge 45 of cap area 20 and folded. Due to the thickness disparity between skeleton 16 and adjacent field tiles 21, thickness compensating fingers 43 are needed to provide a pest seal against the top of the down slope field tile 21 when pan flange 24 is fitted to the pan of an adjacent field tile such as pan 25 as shown in FIG. 1.

In FIGS. 8–11 installation steps for roof vent 10 are illustrated. Referring now to FIG. 8, location 57 on roof deck 56 is selected for installation of roof vent 10. Location 57 is marked to delineate where attic opening 58 will be cut. As shown in FIG. 9, saw 59 is used to cut attic opening 58 through roof deck 56. In FIG. 10, sealant 61 is applied to bottom side 41 of primary vent 40. Primary vent 40 is installed with bottom side 41 in contact with roof deck 56 and vent opening 46 in ventilating communication with attic opening 58. As shown in FIG. 11, secondary vent 12 is then installed above primary vent 40 with vent openings 36 in ventilation communication with vent opening 46. Fasteners (not shown) are attached through holes 34 into batten 70 to secure secondary vent 12.

For effective attic ventilation, roof vents 10 should be used in pairs. A pair of roof vents 10 are located on a roof parallel to the rafters with a first roof vent 10 near the roof peak (not shown) and a second roof vent 10 near eave 60. This configuration promotes passive air convection through the attic or rafter space as warm air rises through the first roof vent 10 cooler air is drawn into the attic or rafter space through second roof vent 10.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims.

What is claimed is:

1. A roof system for a sloped roof, comprising:

a plurality of roofing tile segments mounted on the roof in horizontal rows forming alternating parallel pan channels and cap columns to channel rain and snow;

one of the tile segments including a vent skeleton having an upslope edge and a downslope edge said vent skeleton is formed of a single continuous piece of material having an exposed pan section forming a segment of pan channel and a cap section, including one or more skeleton vent openings in ventilating communication with a vent opening through the roof, said cap section forming a segment of a cap column, the pan and cap sections being overlapped by tile segments in an upslope row of tile segments and overlapping tile segments in a downslope row of tile segments; and a vent cap having an elongated axis parallel to the cap column and extending from the portion of the cap section overlapped by tile segments in the upslope row to form a vent opening in ventilating communication with the skeleton vent opening.

2. The invention as claimed in claim 1, wherein said vent skeleton and said vent cap are formed of aluminum or galvanized steel or copper.

3. The invention as claimed in claim 1, wherein said vent skeleton further comprises:

a plurality of ribs.

4. The invention as claimed in claim 3, wherein said plurality of ribs are parallel to said horizontal rows.

5. The invention as claimed in claim 3, wherein said plurality of ribs are formed into said single continuous piece of material.

6. The invention claimed in claim 1, wherein said upslope and downslope edges precisely fit against adjacent upslope and downslope field tiles respectively.

7. The invention claimed in claim 1, wherein said vent skeleton has a cap flange to precisely fit under and against a cap of an adjacent field tile.

8. The invention claimed in claim 1, wherein said vent skeleton has a pan flange to precisely fit against a pan of an adjacent field tile.

9. The invention claimed in claim 1, wherein said vent skeleton and said vent cap are mounted together in the shape of an S-style tile.

10. The invention claimed in claim 1, wherein said vent skeleton and said vent cap are mounted together in the shape of double-wide roof tiles.

11. The invention claimed in claim 1, wherein said vent skeleton and said vent cap are mounted together in the shape of the surrounding roof tiles.

12. The invention claimed in claim 3, further comprising:

said vent skeleton and said vent cap painted or fused with color to match the surrounding roof tiles.

13. The invention as claimed in claim 9, wherein said vent skeleton and said vent cap are mounted together in the shape of an S-style clay tile.

14. The invention as claimed in claim 9, wherein said vent skeleton and said vent cap are mounted together in the shape of an S-style concrete tile.

15. The invention as claimed in claim 1, wherein said vent skeleton and said vent cap are mounted together in the shape of the plurality of roofing tile segments.

16. The invention as claimed in claim 15, wherein said vent skeleton and said vent cap are painted or fused with color to match the plurality of roofing tile segments.

17. A roof system for a sloped roof, comprising:

a plurality of roofing tile segments mounted on the roof in horizontal rows forming alternating parallel pan channels and cap columns to channel rain and snow;

one of the tile segments including a vent skeleton having an upslope edge and a downslope edge said vent skeleton is formed of a single continuous piece of material having a plurality of ribs, an exposed pan section forming a segment of pan channel and a cap section, including one or more skeleton vent openings in ventilating communication with a vent opening through the roof, said cap section forming a segment of a cap column, the pan and cap sections being overlapped by tile segments in an upslope row of tile segments and overlapping tile segments in a downslope row of tile segments;

a vent cap in the shape of a portion of the cap column and extending from the portion of the cap section overlapped by tile segments in the upslope row to form a vent opening in ventilating communication with the skeleton vent opening; and said vent skeleton and said vent cap are formed of aluminum or galvanized steel or copper.

18. The invention as claimed in claim 17, wherein said plurality of ribs are parallel to said horizontal rows.

19. The invention as claimed in claim 18, wherein said plurality of ribs are formed into said single continuous piece of material.

20. The invention claimed in claim 12, wherein said vent skeleton further comprises:

a cap flange to precisely fit under and against a cap of an adjacent field tile;

a pan flange to precisely fit against a pan of an adjacent field tile; and wherein said upslope and downslope edges of said vent skeleton precisely fit against adjacent upslope and downslope field tiles respectively.

21. The invention as claimed in claim 20, wherein said vent cap further comprises:

a front hem extending along a front edge;

a side hem extending along one or more side edges adjacent said front edge;

a plurality of ribs.

22. The invention as claimed in claim 21, wherein said ribs are parallel to said front edge.

23. The invention as claimed in claim 21, wherein said plurality of ribs, said vent cap, said side and front edges are formed of a single continuous piece of material.

24. The invention as claimed in claim 17, wherein said vent skeleton and said vent cap are mounted together in the shape of the plurality of roofing tile segments.

25. The invention as claimed in claim 17, wherein said vent skeleton and said vent cap are mounted together in the shape of the plurality of roofing tile segments.

26. The invention as claimed in claim 25, wherein said vent skeleton and said vent cap are painted or fused with color to match the plurality of roofing tile segments.

* * * * *